US007513741B2

(12) United States Patent
Smiley, III et al.

(10) Patent No.: US 7,513,741 B2
(45) Date of Patent: Apr. 7, 2009

(54) FAN INLET FLOW DISTRIBUTOR

(75) Inventors: William A. Smiley, III, La Crosse, WI (US); Pravinchandra C. Mehta, Clarksville, TN (US)

(73) Assignee: Trane International Inc., Piscataway, NJ (US)

( * ) Notice: Subject to any disclaimer, the term of this patent is extended or adjusted under 35 U.S.C. 154(b) by 402 days.

(21) Appl. No.: 11/375,857

(22) Filed: Mar. 15, 2006

(65) Prior Publication Data

US 2007/0217906 A1 Sep. 20, 2007

(51) Int. Cl.
*F04D 29/44* (2006.01)

(52) U.S. Cl. ..... 415/205; 415/208.1

(58) Field of Classification Search ..... 415/208.1, 415/205, 182.1, 206
See application file for complete search history.

(56) References Cited

U.S. PATENT DOCUMENTS 820,398 A 5/1906 Davidson
820,399 A 5/1906 Davidson
4,295,416 A 10/1981 Gorchev et al.
4,319,521 A 3/1982 Gorchev et al.
4,549,848 A 10/1985 Wallman
5,531,267 A * 7/1996 Ahmed et al. ..... 415/208.1
5,570,996 A 11/1996 Smiley, III
5,614,774 A * 3/1997 McCallops et al. ..... 415/208.1
6,027,406 A 2/2000 Yazici
2001/0018023 A1 * 8/2001 Tagomori et al. ..... 415/208.1

FOREIGN PATENT DOCUMENTS

JP 59-196997 11/1984

* cited by examiner

*Primary Examiner*—Richard Edgar
(74) *Attorney, Agent, or Firm*—William O'Driscoll

(57) ABSTRACT

A fan inlet flow distributor comprises a skewed elliptical cone or equivalent body installed between an inlet opening of a centrifugal blower and an adjacent wall that faces the inlet. When all of the incoming airflow approaches the blower from the same general direction parallel to the wall and then makes a right turn to enter the blower's inlet, the unique shape of the flow distributor promotes a circumferentially uniform flow pattern as the air enters the fan's inlet. In some embodiments, the flow distributor comprises a skewed elliptical hyperboloid near its base and a skewed elliptical paraboloid near its vertex. The flow distributor is preferably attached to the wall and spaced apart from the fan's housing to ensure an unobstructed flow path between the distributor and the fan housing.

9 Claims, 4 Drawing Sheets

FAN INLET FLOW DISTRIBUTOR

BACKGROUND OF THE INVENTION

1. Field of the Invention

The subject invention generally pertains to centrifugal blowers and more specifically to an inlet flow distributor for such a blower.

2. Description of Related Art

Centrifugal fans and blowers usually have a fan wheel that draws air in a direction generally parallel to the fan wheel's rotational axis and discharges the air in a tangential or radial direction that is normally perpendicular to the axis. In cases where the blower is installed inside an enclosure, the blower's inlet may face a side wall of the enclosure. If that side wall is too close to the inlet, the wall can disturb an otherwise uniform airflow pattern into the blower's inlet. Such a disruption can create undesirable swirling of the air and reduce the fan's performance.

Although it appears that little if any effort has been applied to addressing the problem of a blower's inlet being too close to an adjacent wall, some blowers have inlet flow directors for dealing with other problems associated with centrifugal blowers. Examples of such deflectors are disclosed in Japanese Patent Application 59-196997 and U.S. Pat. Nos. 5,570,996; 4,549,848; 820,399; and 820,398. In each of these examples, the deflector is somewhat of a funnel with an inner surface that channels the airflow in a desired direction.

In the '398, '399, and '848 patents, it appears that the fan housing needs to be enlarged to accommodate the added deflector. Enlarging the housing can increase its cost and perhaps decrease the blower's efficiency. Moreover, the '398 patent shows significant swirling, mixing, and recirculation of the air.

The blower of the '996 patent does require a larger fan housing; however, the deflector extends a significant distance into the housing and actually obstructs a portion of the fan wheel. Although the deflector of the '996 may have an overall positive effect on the blower's efficiency, some loss may still occur where the deflector directly obstructs the fan wheel. The Japanese reference shows a deflector that not only extends into the fan wheel but also chokes off about half of the fan's inlet.

None of the aforementioned references show a blower with an inlet facing an adjacent wall. U.S. Pat. Nos. 6,027,406; 4,295,416 and 4,319,521, however, show inlet silencers that help guide suction air into a blower. Each of the silencers appears to be a symmetrical body that receives airflow from multiple radial directions and redirects the airflow upward into an inlet opening of the blower. It does not appear that the inlet silencers correct any non-uniform incoming airflow pattern.

Consequently, a need still exists for an inlet flow distributor that corrects the non-uniform airflow pattern created by a wall in proximity to a fan inlet.

SUMMARY OF THE INVENTION

It is an object of the invention to more uniformly distribute the air entering a centrifugal blower whose inlet opening generally faces an adjacent wall.

Another object of some embodiments is to guide a circumferentially uniform airflow pattern into a centrifugal blower using an asymmetrical cone, wherein the center of the cone's base and/or the cone's vertex is displaced out of collinear alignment with the rotational axis of the fan wheel.

Another object of some embodiments is to avoid obstructing a generally circular inlet opening of a centrifugal blower.

Another object of some embodiments is to provide an air-handling unit where an inlet flow distributor can be mounted to an adjacent wall rather than being supported by the blower housing. This allows the inlet flow distributor to be readily shaped according to size of the blower and the distance between the blower housing and the wall, rather than be sized solely based on the dimensions of the blower housing alone.

Another object of some embodiments is to provide a fan inlet flow distributor with a closed outer surface and a hollow interior to reduce the cost and weight of the distributor.

Another object of some embodiments is to provide a fan inlet flow distributor with a skewed elliptical hyperboloid and a skewed elliptical paraboloid to ensure a smooth, uniform airflow pattern entering the inlet of a centrifugal blower.

One or more of these and/or other objects of the invention are provided by an inlet flow distributor for a centrifugal blower, wherein the flow distributor comprises a skewed cone that promotes a circumferentially uniform airflow pattern leading into the blower's generally round inlet opening.

The present invention provides a centrifugal blower for moving a current of air. The centrifugal blower comprises a wall; a blower housing defining a blower inlet that generally faces the wall; a fan wheel disposed within the blower housing, and an inlet flow distributor interposed between the wall and the blower inlet. The fan wheel is rotatable about an axis to draw the current of air through the blower inlet and into the blower housing. The inlet flow distributor includes a base, a nose, and an outer surface. More than half of the outer surface faces away from the axis.

The present invention also provides a centrifugal blower for moving a current of air. The centrifugal blower comprises a wall; a blower housing defining a blower inlet that generally faces the wall; a fan wheel disposed within the blower housing, and an inlet flow distributor interposed between the wall and the blower inlet. The fan wheel is rotatable about an axis to draw the current of air through the blower inlet and into the blower housing. The inlet flow distributor includes a base, a nose, and an outer surface. More than half of the outer surface faces away from the axis. The base has a base center of area, the nose has a peak center, and the axis is closer to the peak center than to the base center of area.

The present invention further provides a method of directing a current of air into a blower inlet defined by a blower housing of a centrifugal blower. The blower housing contains a fan wheel that can rotate about an axis to draw the current of air into the blower housing, and the blower inlet generally faces a wall that traverses the axis. The method comprises directing the current of air in a generally same direction that is generally perpendicular to the axis; conveying the current of air between the wall and the blower housing; causing the current of air to impinge on an inlet flow distributor having an outer surface, the majority of which outer surface faces away from the axis; and redirecting the current of air through the blower inlet such that the current of air is substantially evenly distributed around the axis as the current of air passes through the blower inlet.

DESCRIPTION OF THE PREFERRED EMBODIMENT

Figure 1:
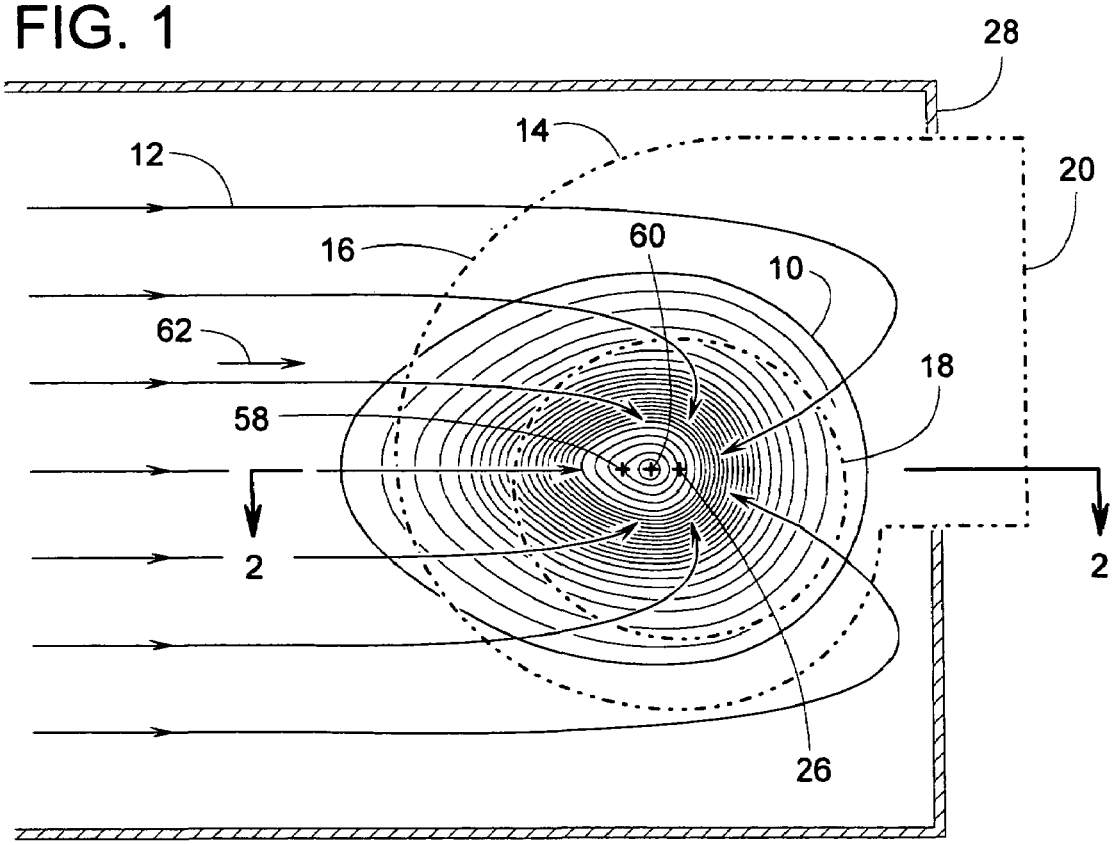
FIG. 1 is a side view of a flow distributor with a centrifugal blower shown in phantom lines and an HVAC enclosure shown as a cross-section taken along line 1-1 of FIG. 2.
Figure 2:
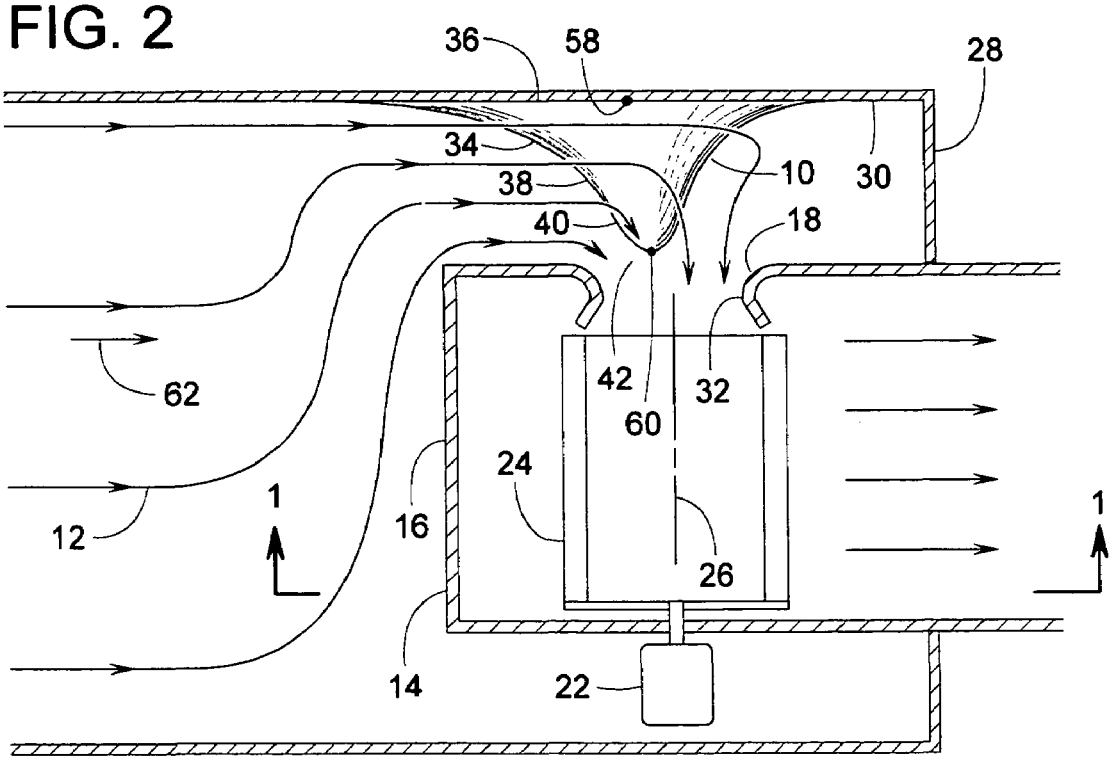
FIG. 2 is a top view of the flow distributor of FIG. 1 with the enclosure and blower housing shown in cross-section taken along line 2-2 of FIG. 1.

FIGS. 1 and 2 illustrate an inlet flow distributor 10 for evenly distributing a current of air 12 into a centrifugal blower 14. Blower 14 comprises an involute blower housing 16 having a generally round blower inlet 18 and a blower outlet 20. A motor 22 rotates a conventional fan wheel 24 about an axis 26 within housing 16 to centrifugally force the current of air 12 from inlet 18 to outlet 20.

In this particular example, housing 16 is contained within an air-handling enclosure 28 that conveys air 12 toward inlet 18. Enclosure 28 and blower 14 can be part of a conventional HVAC system that may further include various HVAC components such as heat exchangers, compressors, filters, etc.

Flow distributor 10 is most useful when inlet 18 generally faces a wall 30 of enclosure 28 because without distributor 10, wall 30 can cause air 12 to enter inlet 18 in an unfavorable flow pattern. With wall 30 in proximity to inlet 18 and without distributor 10, the airflow velocity may actually be higher just upstream of inlet 18. This condition may force the airflow to first accelerate and then decelerate as the incoming air turns to enter inlet 18. Upon completing the turn, air 12 may again accelerate as it passes through a throat 32 of inlet 18. The resulting airflow could be non-uniform in circumferential distribution, direction, pressure and velocity, which could induce swirl, and thus reduce the performance of blower 14.

With flow distributor 10 installed between wall 30 and inlet 18, distributor 10 helps guide air 12 in a more circumferentially uniform pattern through inlet 18, as shown in FIG. 1. Blower housing 16 and inlet 18 are shown in phantom lines in FIG. 1 to show distributor 10 and the airflow pattern more clearly.

Figure 3:
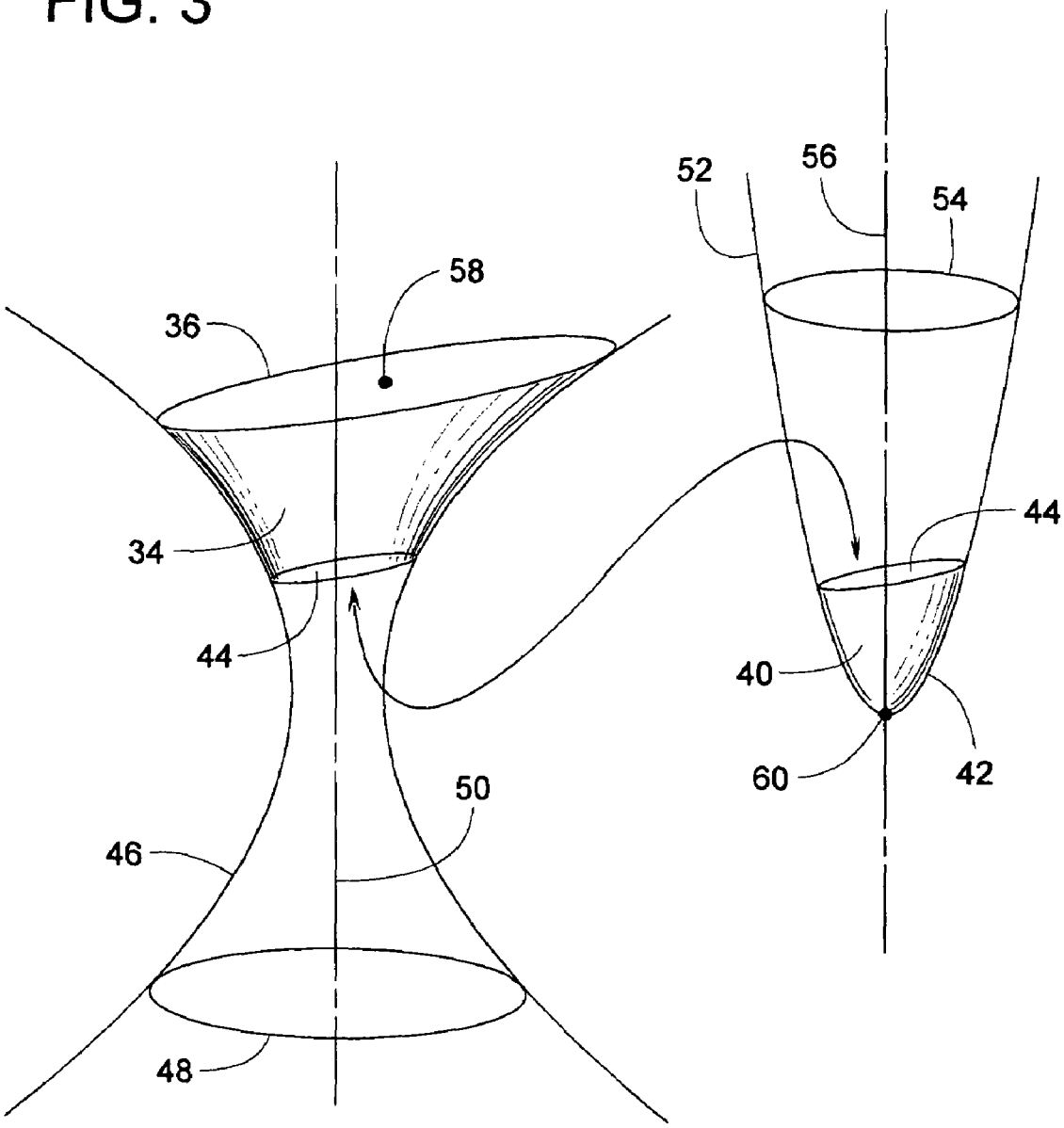
FIG. 3 is diagram illustrating the generation of a skewed elliptical hyperboloid and a skewed elliptical paraboloid.

To achieve such a uniform airflow pattern, distributor 10 has an outer surface 34 that defines a skewed elliptical base 36, an intermediate hyperbolic surface 38 (e.g., skewed elliptical hyperboloid) adjacent to base 36, and a parabolic surface 40 (e.g., skewed elliptical paraboloid) located adjacent the intermediate surface 38 and creating a nose 42 of distributor 10. More than half of the outer surface 34 faces in a direction away from the axis 26. Consequently, more than half, if not all, of the airflow passes between outer surface 34 and blower housing 16 prior to entering housing 16 through inlet 18. Referring to FIG. 3, the transition between hyperbolic surface 34 and parabolic surface 40 generally defines a skewed elliptical transition 44.

FIG. 3 shows how hyperbolas 46 passing through an ellipse 48 and sharing a common centerline 50 can define hyperbolic surface 34, and a plane slicing surface 34 at a non-perpendicular angle to centerline 50 can define the skewed elliptical base 36. A second plane slicing surface 34 can create the skewed elliptical transition 44. Likewise, parabolas 52 passing through an ellipse 54 and sharing a common centerline 56 can define parabolic surface 40, and slicing surface 40 can also define the skewed elliptical transition 44. In some cases, if the skewed elliptical transitions created by slicing parabolic surface 40 and hyperbolic surface 34 are not identical, some blending of surfaces 34 and 40 may be needed where surfaces 34 and 40 meet at transition 44.

By skewing surfaces 34 and 40, base 36 has a base center of area 58 that is radially offset to a peak center 60 of nose 42. This helps promote a circumferentially uniform flow pattern into inlet 18 when the airflow generally approaches blower 14 from a same general direction 62, which is generally perpendicular to axis 26. In some cases, peak center 60 and/or base center of area 58 may be advantageously offset to axis 26 in a direction opposite of direction 62.

The actual construction of flow distributor 10 may vary. Distributor 10, for example, could be blanked and formed from sheet metal, vacuum formed from a thermoplastic sheet, blow molded, plastic injection molded, etc. To minimize cost and weight, distributor 10 can be hollow or made of foam. In some embodiments, distributor 10 is comprised of structural foam, which has a smooth skin and a foam core. Numerous other structures and manufacturing methods known to those of ordinary skill in the art are well within the scope of the invention.

Some type of bracket could be used to attach flow distributor 10 to housing 16; however, it may be preferable to attach flow distributor 10 directly to wall 30, as brackets extending between housing 16 and distributor 10 could disturb the airflow. Attaching flow distributor 10 directly to wall 30 and spaced apart from housing 16, as shown in FIG. 2, eliminates the need for such brackets.

Figure 6:
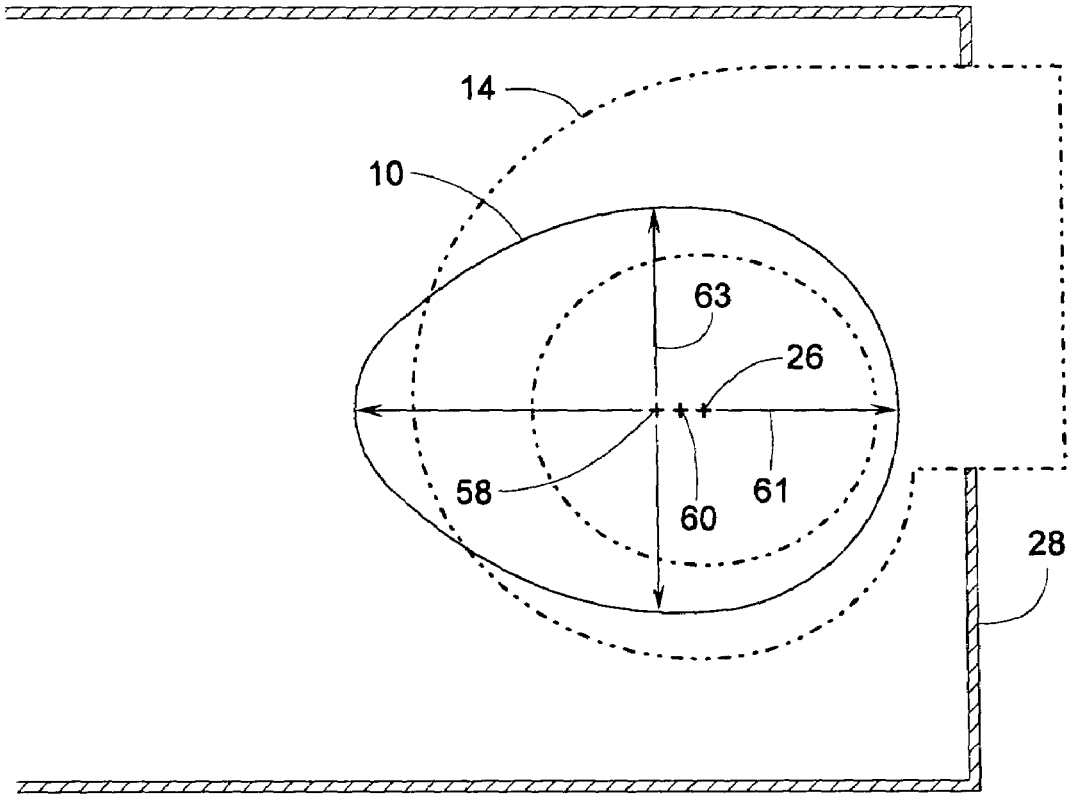
FIG. 6 is a side view similar to FIG. 1 but showing some dimensional relationships.
Figure 7:
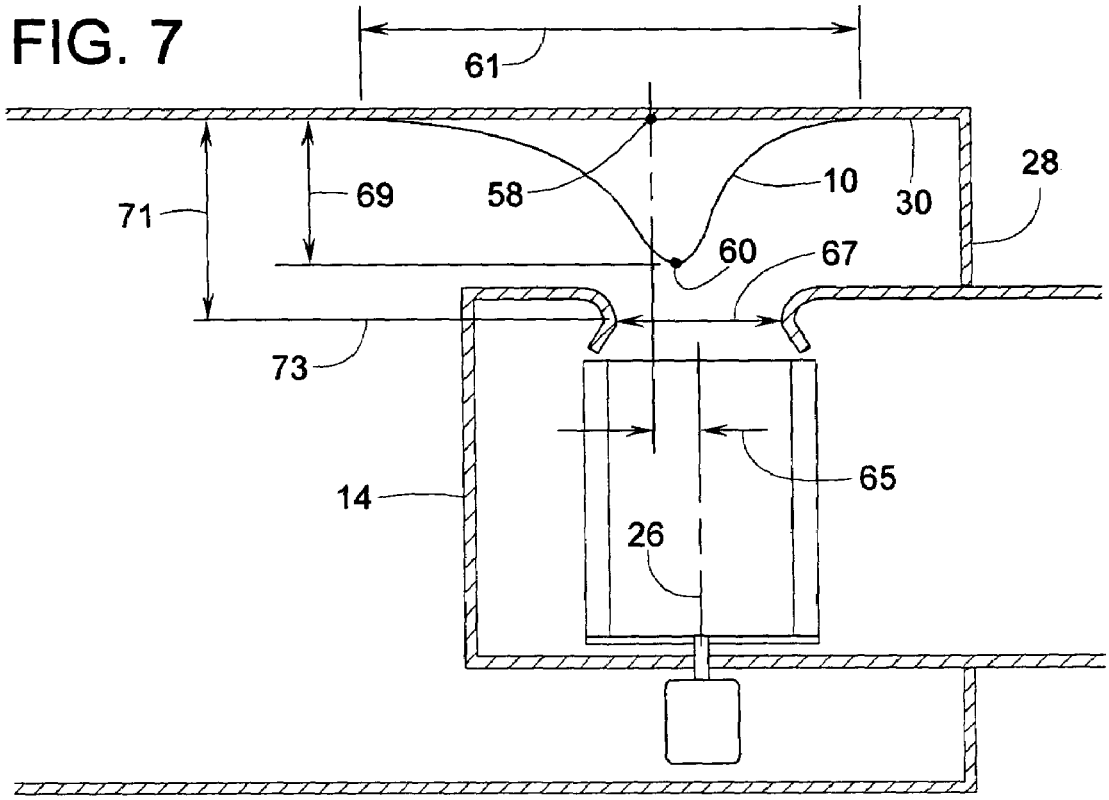
FIG. 7 is a top view similar to FIG. 2 but showing some dimensional relationships.

Although the exact dimensions of flow distributor 10 may vary, in some embodiments the dimensions are as shown in FIGS. 6 and 7. Flow distributor 10, for example, may have a major axis of ellipse 61 and a minor axis of ellipse 63, wherein a first ratio of major axis 61 to minor axis 63 (the length of axis 61 divided by the length of axis 63) can be from 1.2 to 1.4 and is preferably 1.3. A second ratio defined as an offset 65 between base center of area 58 and axis 26 divided by a throat diameter 67 (offset 65 divided by diameter 67) can be from 0.15 to 0.2 and is preferably 0.17. A third ratio defined as distributor height 69 divided by throat diameter 67 can be from 0.9 to 1.15 and is preferably 1.08. A fourth ratio defined as a wall spacing 71 divided by throat diameter 67 can be 0.7 to 1.4 and is preferably 1.25. Wall spacing 71 extends from wall 30 to an imaginary plane 73 lying along the minimum throat diameter of inlet 18. A fifth ratio defined as height 69 divided by wall spacing 71 can be 0.7 to 1.0 and is preferably 0.87. It should be noted that these ranges of values are for currently preferred embodiments, and it is conceivable that values beyond these ranges may also provide beneficial results, thus the invention is not limited to just these particular ranges.

Figure 4:
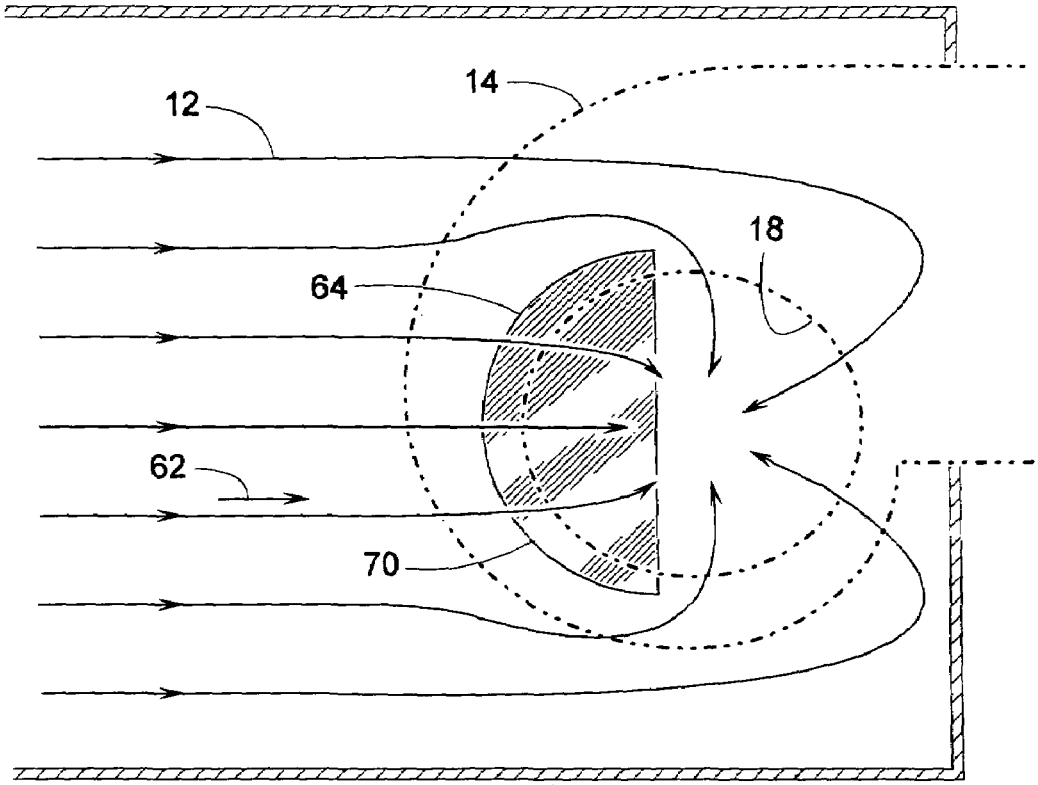
FIG. 4 is a side view similar to FIG. 1 but showing an alternate embodiment.
Figure 5:
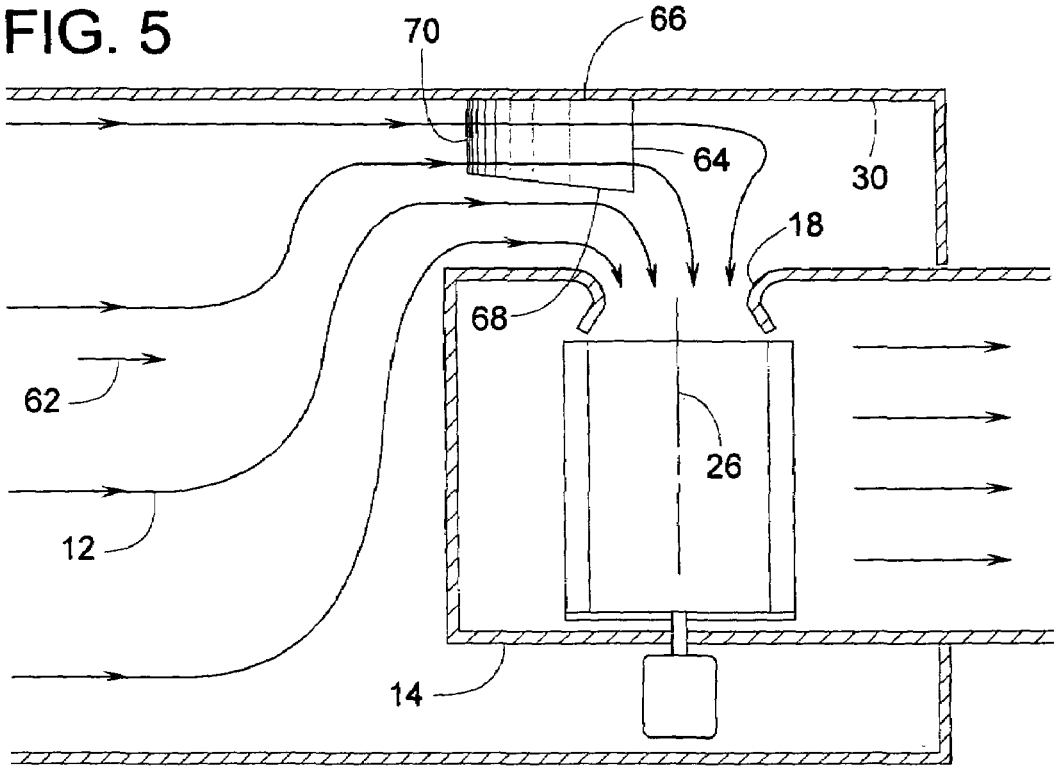
FIG. 5 is a top view similar to FIG. 2 but showing the embodiment of FIG. 4.

In an alternate embodiment, shown in FIGS. 4 and 5, an inlet flow distributor 64 comprises a generally semi-cylindrical body. Flow distributor 64 includes a base 66 attached to wall 30 and a nose 68 generally facing blower 14. To ensure even circumferential airflow into inlet 18, some air passes between nose 68 and the rest is diverted around distributor 64 before entering inlet 18. The actual shape of flow distributor 64 may vary. Nose 68, for example, can be flat or curved. If flat, nose 68 could be perpendicular to axis 26 or lie at an incline as shown in FIG. 5. An outer surface 70 of distributor 64 could be semi-cylindrical, as shown in FIG. 4, or surface 70 could be some other shape.

Although the invention is described with respect to a preferred embodiment, modifications thereto will be apparent to those of ordinary skill in the art. Therefore, the scope of the invention is to be determined by reference to the following claims.

The invention claimed is:

1. A centrifugal blower for moving a current of air, the centrifugal blower comprising: a wall; a blower housing defining a blower inlet that generally faces the wall; a fan wheel disposed within the blower housing, the fan wheel being rotatable about at axis to draw the current of air downstream along the wall, through the blower inlet and into the blower housing; and an inlet flow distributor interposed between the wall and the blower inlet, the inlet flow distributor includes a base, a nose, and an outer surface, wherein more than half of the outer surface is upstream of the axis and a peak center of the nose is displaced out of collinear alignment with the axis.

2. The centrifugal blower of claim 1, wherein the base has a substantially skewed elliptical shape.

3. The centrifugal blower of claim 1, wherein the outer surface of the Inlet flow distributor comprises a substantially hyperbolic surface adjacent to the base.

4. The centrifugal blower of claim 1, wherein the outer surface of the inlet flow distributor comprises a substantially parabolic surface adjacent to the nose.

5. A centrifugal blower for moving a current of air, the centrifugal blower comprising: a wall; a blower housing defining a blower inlet that generally faces the wall; a fan wheel disposed within the blower housing, the fan wheel being rotatable about an axis to draw the current of air downstream along the wall through the blower inlet and into the blower housing; and an inlet flow distributor interposed between the wall and the blower inlet, the inlet flow distributor includes a base, a nose, and an outer surface, wherein more than half of the outer surface is upstream of the axis, the base has a base center of area, the nose has a peak center, the peak center is displaced out of collinear alignment with the axis, and the axis is closer to the peak center than to the base center of area.

6. The centrifugal blower of claim 5, wherein the base is closer to the wall than to the blower inlet, the nose is closer to the blower inlet than to the wall, more than half of the current of air passes between the blower housing and the outer surface before entering the blower housing through the blower inlet.

7. The centrifugal blower of claim 5, wherein the base has a substantially skewed elliptical shape.

8. The centrifugal blower of claim 5, wherein the outer surface of the inlet flow distributor comprises a substantially hyperbolic surface adjacent to the base.

9. The centrifugal blower of claim 5, wherein the outer surface of the inlet flow distributor comprises a substantially parabolic surface adjacent to the nose.

* * * * *